US010656580B2

(12) United States Patent
Ogawara et al.

(10) Patent No.: US 10,656,580 B2
(45) Date of Patent: May 19, 2020

(54) IMAGE FORMING APPARATUS CONTROLLING CHARGING BIAS AND TRANSFER BIAS

(71) Applicant: CANON KABUSHIKI KAISHA, Tokyo (JP)

(72) Inventors: Satoshi Ogawara, Koshigaya (JP); Takashi Uehara, Kamagaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/623,840

(22) Filed: Jun. 15, 2017

(65) Prior Publication Data

US 2017/0364010 A1 Dec. 21, 2017

(30) Foreign Application Priority Data

Jun. 16, 2016 (JP) ..... 2016-120233

(51) Int. Cl.
*G03G 15/00* (2006.01)
*G03G 15/02* (2006.01)
*G03G 15/16* (2006.01)

(52) U.S. Cl.
CPC ..... *G03G 15/50* (2013.01); *G03G 15/0266* (2013.01); *G03G 15/1665* (2013.01); *G03G 15/1675* (2013.01)

(58) Field of Classification Search
CPC ..... G03G 15/50; G03G 15/0266; G03G 15/14–15/1625
USPC ..... 399/46
See application file for complete search history.

(56) References Cited

U.S. PATENT DOCUMENTS

| | | | | |
|---|---|---|---|---|
| 9,091,969 | B2 * | 7/2015 | Yoshida | G03G 15/1675 |
| 9,244,380 | B2 | 1/2016 | Tsukada et al. | |
| 2013/0195486 | A1 * | 8/2013 | Murayama | G03G 15/1605 399/66 |
| 2016/0077456 | A1 * | 3/2016 | Kojima | G03G 15/0266 399/50 |

FOREIGN PATENT DOCUMENTS

| | | | |
|---|---|---|---|
| JP | 2014-052502 | A | 3/2014 |
| JP | 2014-170156 | A | 9/2014 |
| JP | 2016-085317 | A | 5/2016 |

* cited by examiner

*Primary Examiner* — Walter L Lindsay, Jr.
*Assistant Examiner* — Arlene Heredia
(74) *Attorney, Agent, or Firm* — Venable LLP

(57) ABSTRACT

An image forming apparatus includes an image bearing drum; a drum charging member, disposed at a charging position opposed to the drum, for applying the drum with a charging bias; a developing member for developing an electrostatic image formed on the drum with toner, with a developing bias; a transfer member for transferring a toner image from the drum onto a sheet, with a transfer bias; a transfer bias source for outputting the transfer bias; and a controller for effecting control to start raising of the transfer bias so as to correspond to a timing at which an area of the drum passing at a timing of starting of raising of the charging bias passes the transfer position and to complete the raising of the transfer bias so as to correspond to a timing at which an area of the drum passing at a timing of completion of raising of the charging bias passes the transfer position.

7 Claims, 10 Drawing Sheets

(a)

(b)

IMAGE FORMING APPARATUS CONTROLLING CHARGING BIAS AND TRANSFER BIAS

FIELD OF THE INVENTION AND RELATED ART

The present invention relates to an image forming apparatus which forms an image on recording medium with the use of an electrophotographic method, an electrostatic recording method, or the like.

In the past, an electrophotographic image forming apparatus has been widely used as a copying machine, a printing machine, a plotting machine, a facsimile machine, and a multifunction machine having two or more functions of the preceding machines. In this type of image forming apparatus, an electrostatic latent image is formed by uniformly charging the peripheral surface of its photosensitive drum, and scanning (exposing) the uniformly charged peripheral surface of the photosensitive drum to a beam of laser light or the like emitted while being modulated in accordance with the data of the image to be formed. Then, the electrostatic latent image is developed with the use of toner into a toner image. Then, the toner image on the peripheral surface of the photosensitive drum is directly transferred onto a sheet of recording medium (transfer paper or the like), or temporarily transferred onto an intermediary transferring member, and then, is transferred onto a sheet of recording medium. Then, the sheet is conveyed through a fixing apparatus to fix the toner image on the sheet to the sheet. Then, the sheet having the fixed toner image is discharged from the main assembly of the image forming apparatus.

The length of time it takes for the first sheet of recording medium to be discharged from an image forming apparatus after a user of the apparatus presses the image formation start button of the apparatus is referred to as "FCOT" (First Copy Output Time). To a user, this time is a wait time. Thus, it is desired to reduce this time. The wait time can be reduced by reducing the length of time it takes for the image forming portion of an image forming apparatus to become ready for image formation. Thus, it is desired to reduce as much as possible the length of time it takes for the image forming portion to become ready for image formation.

To begin with, referring to FIG. 2, the charging position P1, exposing position P2, developing position P3, and transferring position P4 in an electrophotographic image forming apparatus, and the timings with which the charging, exposing, developing, and transferring processes are carried out, respectively, are described. Referring to FIG. 2, the image forming apparatus is provided with a photosensitive drum, which rotates in the direction indicated by an arrow mark R1. The image forming apparatus is also provided with a charge roller, a developing apparatus, a primary transfer roller, which are disposed in the listed order, in the adjacencies of the peripheral surface of the photosensitive drum. The position in which the peripheral surface of the photosensitive drum is charged by the charge roller is referred to as the charging position P1, and the position in which the peripheral surface of the peripheral surface of the photosensitive drum is exposed to a beam L of laser light to form an electrostatic latent image is referred to as the exposing position P2. Further, the position in which the electrostatic latent image formed in the exposing position P2 is developed by the development sleeve of the developing apparatus which uses toner is referred to as the developing position P3, and the position in which the toner image is transferred by the primary transfer roller onto the intermediary transfer belt, as a member onto which the toner image is temporarily transferred, is referred to as the transferring position P4.

The peripheral surface of the photosensitive drum is negatively charged by charge bias high voltage. The primary transfer roller is positively charged to transfer the toner image onto the intermediary transfer belt. In the transferring position 4, electrical discharge occurs because of the difference in potential level between the peripheral surface of the photosensitive drum and primary transfer roller. However, if the primary transfer bias high voltage is applied while the peripheral surface of the photosensitive drum remains negatively charged to an insufficient level, the peripheral surface of the photosensitive drum becomes positively charged in the transferring position P4. The positively charged peripheral surface of the photosensitive drum fails to be fully charged by the charging high voltage to a preset negative level. Consequently, the peripheral surface of the photosensitive drum becomes nonuniformly charged in terms of potential level. Thus, the image forming apparatus outputs images which are abnormal in density; the apparatus outputs images which have unintended ghost-like stripes (which hereafter may be referred to simply as "horizontal stripes"), which is problematic.

In the past, in order to solve this problem, that is, in order to prevent the peripheral surface of a photosensitive drum from being charged in such a manner that a certain area in terms of the rotational direction of the photosensitive drum is substantially different in potential level from the other, a conventional image forming apparatus is controlled so that while the apparatus is initialized for image formation, the primary transfer bias high voltage begins to be outputted after the charging bias high voltage reaches a desired level. This solution, however, resulted in the creation of another problem. That is, this solution increased the length of time between when the beginning of the outputting of the charge bias high voltage and the starting of image formation, creating the problem that it increased FCOT. For example, there is disclosed in Japanese Laid-open Patent Application No. 2014-170156, an image forming apparatus designed so that the primary transfer bias high voltage output timing corresponds to the charge bias high voltage application starting position of the photosensitive drum. This image forming apparatus is controlled so that overshoot does not occur while the transfer bias high voltage rises, in order to prevent the problem that an image forming apparatus outputs an image, certain portions of which suffer from unintended horizontal strips or stripes which are attributable to the residual effects of the primary transfer bias upon the potential level of the peripheral surface of the photosensitive drum, and the position of which corresponds to the period of the overshooting.

By the way, the impedance of the primary transfer roller is affected by the environment in which the primary transfer roller is used, cumulative length of time the roller is used, and/or the like factors. Thus, the length of time it takes for the primary transfer bias high voltage to rise to a preset level substantially varies. This is also true with a charge roller. That is, the impedance of a charge roller also is affected by the environment in which the roller is used, the cumulative length of time the roller was used, and/or the like factors, and therefore, the length of time it takes for the charge bias high voltage to rise to a preset level significantly varies.

In comparison, in the case of the above-described image forming apparatus disclosed in the Japanese Laid-open Patent Application No. 2014-170156, however, the changes in the length of time it takes for the primary transfer bias high voltage output and charge bias high voltage output to rise to preset levels, which are attributable to the changes in the impedance of the primary transfer roller and that of the charge roller, have not been taken into consideration. In the case of this image forming apparatus, therefore, if the charge bias high voltage output, for example, is slow to rise, whereas the primary transfer bias high voltage output is fast to rise, the primary transfer bias high voltage begins to be applied before the peripheral surface of the photosensitive drum is negatively charged to a satisfactory level. Consequently, a certain area of the peripheral surface of the photosensitive drum, in terms of the rotational direction of the photosensitive drum, becomes positively charged. The positively charged area of the peripheral surface of the photosensitive drum cannot be negatively charged to the desired level by the charge bias high voltage applied by the charge roller. Thus, the peripheral surface of the photosensitive drum becomes nonuniformly charged in potential level. As an electrostatic latent image formed on the peripheral surface of the photosensitive drum, which is nonuniform in potential level as described above, is developed, it yields a toner image suffering from the presence of unintended stairsteps in density, which result in the presence of the aforementioned unintended ghost-like horizontal stripes.

SUMMARY OF THE INVENTION

According to an aspect of the present invention, there is provided an image forming apparatus comprising an image bearing member; a charging member configured to charge said image bearing member at a charging position opposed to said image bearing member, by being supplied with a charging bias voltage; a developing member configured to develop an electrostatic image formed on said image bearing member with toner, by being supplied with a developing bias voltage; a transfer member configured to transfer a toner image formed on said image bearing member, onto a transfer material, by being supplied with a transfer bias voltage; a transfer bias voltage source configured to output the transfer bias voltage; and a controller configured to effect control to start raising of the transfer bias voltage so as to correspond to a timing at which an area of said image bearing member passing at a timing of starting of raising of the charging bias voltage passes the transfer position and to complete the raising of the transfer bias voltage so as to correspond to a timing at which an area of said image bearing member passing at a timing of completion of raising of the charging bias voltage passes the transfer position.

Further features of the present invention will become apparent from the following description of exemplary embodiments with reference to the attached drawings.

Figure 7:
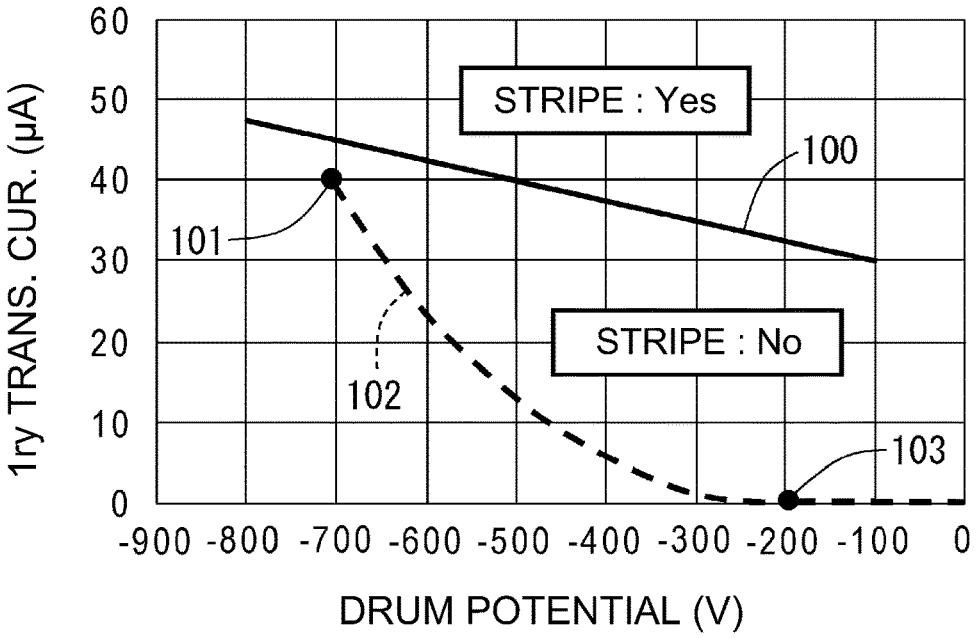
Figure 7:
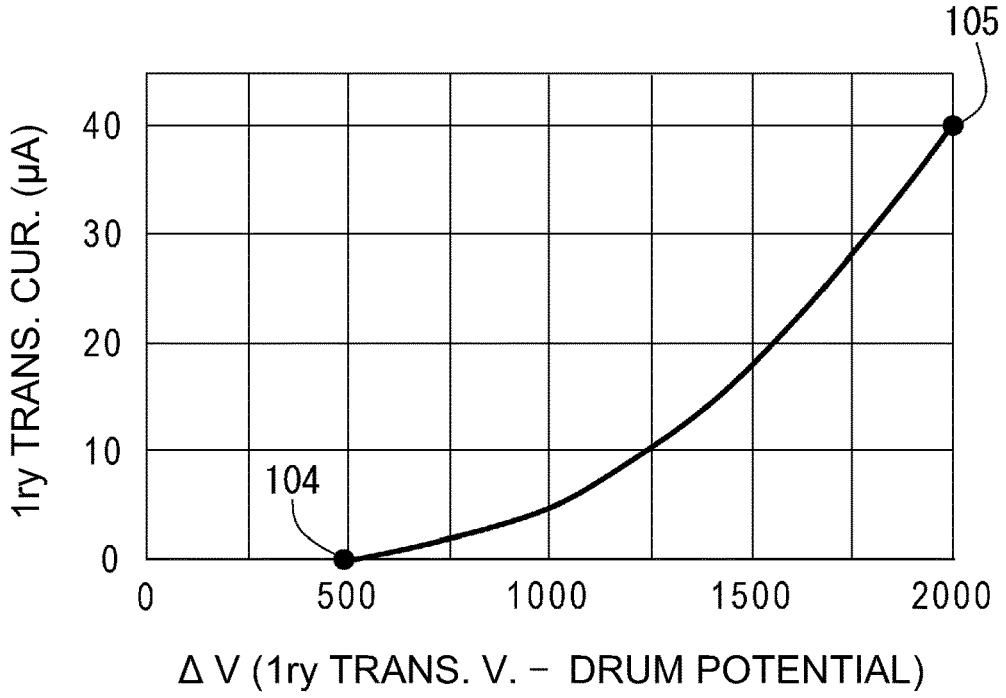

Part (a) of FIG. 7 is a graph which shows the relationship between the surface potential level of the photosensitive drum, amount of the primary transfer current, and presence or absence of unintended horizontal stripes, and part (b) of FIG. 7 is a graph which shows the relationship between the amount ΔV of difference between the primary transfer output voltage and surface potential level of the photosensitive drum, and the amount of the primary transfer current.

Figure 8:
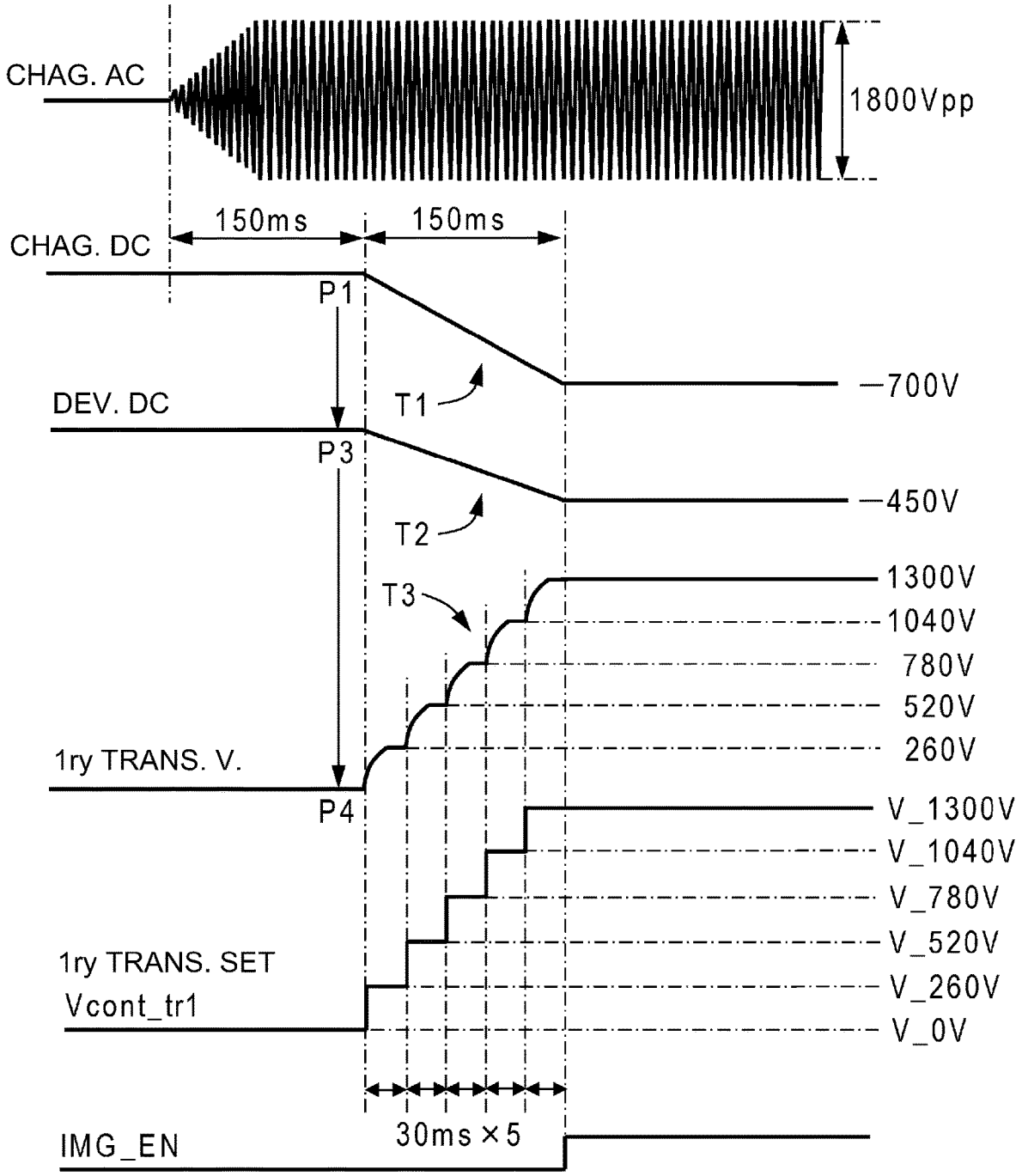

FIG. 8 is a drawing for describing the state in which each of the high voltages is when a given point of the peripheral surface of the photosensitive drum is in the charging position, developing position, and primary transferring position, in the image forming apparatus in the second embodiment of the present invention.

Figure 9:
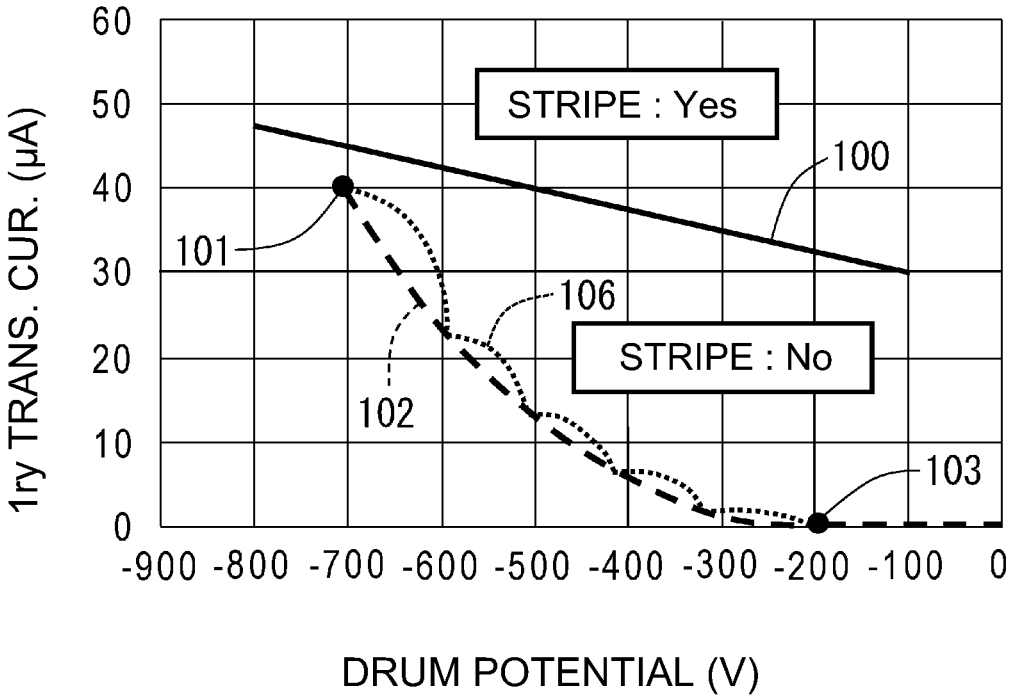

FIG. 9 is a graph which shows the relationship between the surface potential level of the photosensitive drum, amount of the primary transfer current, and presence or absence of unintended horizontal stripes, in the image forming apparatus in the second embodiment.

Figure 10:
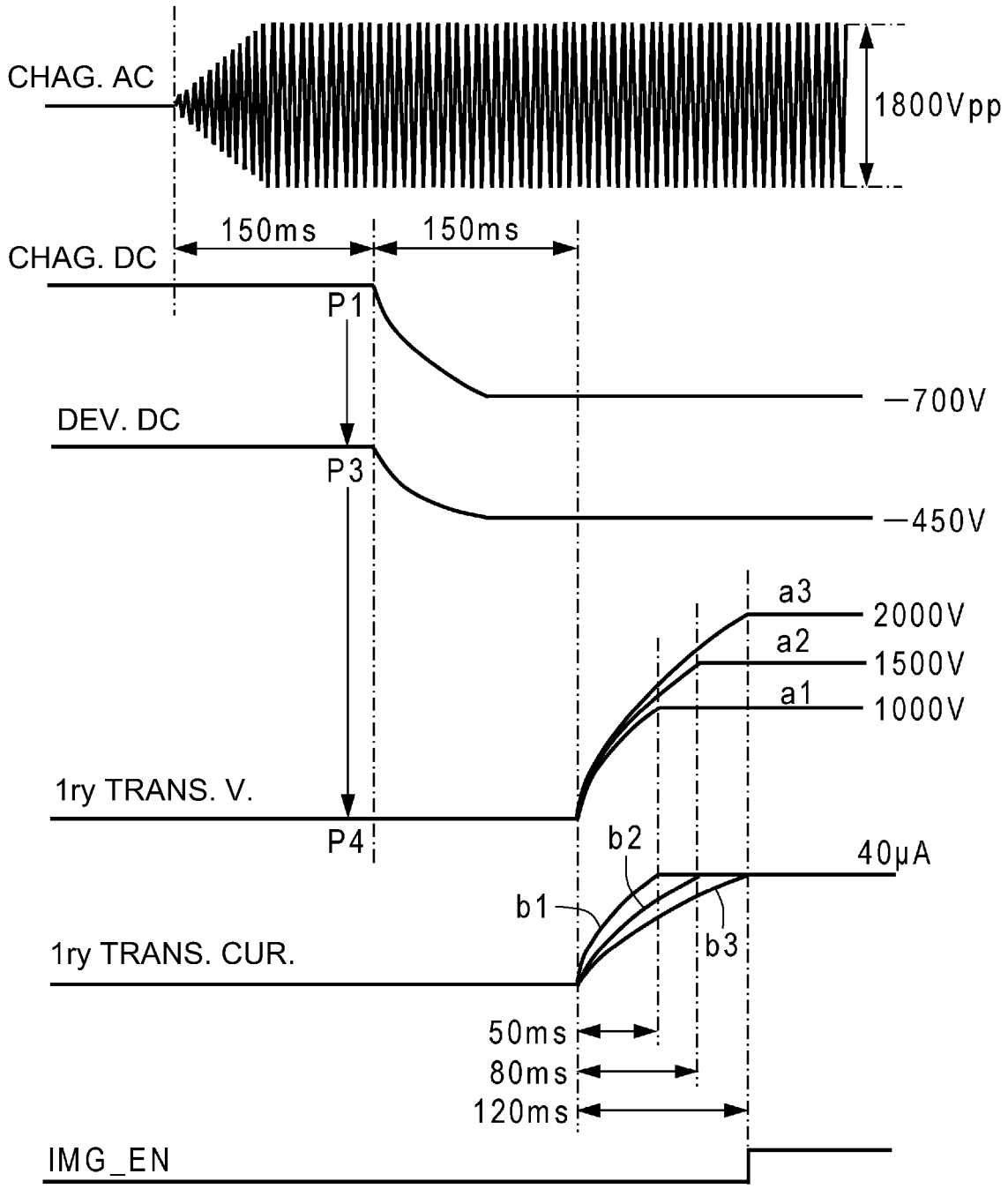

FIG. 10 is a drawing for describing the state in which each of the high voltages is when a given point of the peripheral surface of the photosensitive drum is in the charging position, developing position, and primary transferring position, in a conventional image forming apparatus.

DESCRIPTION OF THE EMBODIMENTS

Embodiment 1

First, the first embodiment of the present invention is described in detail with reference to FIGS. 1-7. The image forming apparatus in this embodiment is a full-color printer of the so-called tandem type.

Figure 1:
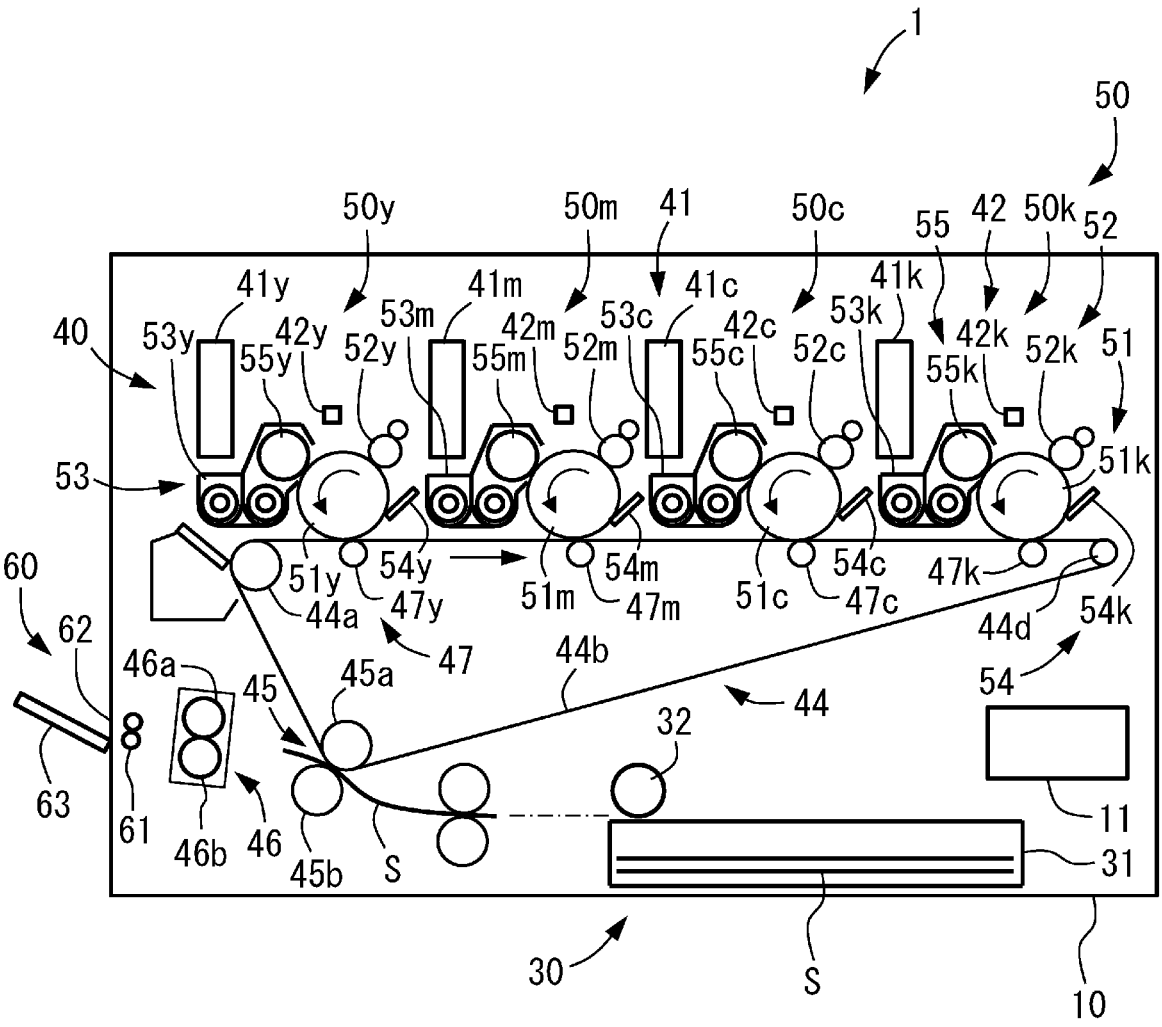
FIG. 1 is a schematic sectional view of the image forming apparatus in the first embodiment of the present invention, which shows the general structure of the apparatus.

Referring to FIG. 1, the image forming apparatus 1 has: a main assembly 10, a sheet feeding-conveying portion 30, an image forming portion 40, a sheet discharging portion 60, and a controlling portion 11. By the way, a sheet S of recording medium is a medium on which a toner image is formed. More concrete examples of recording medium are a sheet of ordinary paper, a sheet of synthetic resin, a sheet of card stock, a sheet of film for an overhead projector, and the like.

The sheet feeding-conveying portion 30 is disposed in the bottom portion of the apparatus main assembly 10. It comprises: a sheet cassette 31 in which multiple sheets S of recording medium are storable in layers; and a sheet feeding-conveying roller 32. It supplies the image forming portion 40 with the sheet S.

The image forming portion 40 has: image formation units 50*y*, 50*m*, 50*c* and 50*k*; and toner bottles 41*y*, 41*m*, 41*c* and 41*k*; exposing apparatuses 42*y*, 42*m*, 42*c* and 42*k*; an intermediary transfer unit 44; a secondary transferring portion 45; and a fixing portion 46. Incidentally, the image forming apparatus 1 in this embodiment is capable of forming a full-color image. The image formation units 50*y*, 50*m*, 50*c* and 50*k* are similar in structure, and are different only in the color (yellow, magenta, cyan and black, respectively) of the toner they use. Thus, when the units are described with reference to FIGS. 2-5, they may be described together without the suffixes which indicate the toner color, although, in drawings, the referential codes for the units have the suffixes which indicate the color of the toner they use.

The image formation unit 50 has: a photosensitive drum 51 (image bearing member) on which a toner image is formed; a charge roller 52 (charging means); a developing apparatus 53 (developing means); and a regulating blade 54. The photosensitive drum 1 and charge roller 52 are driven by an unshown drum motor.

The photosensitive drum 51 has: an aluminum cylinder; and a negatively chargeable photosensitive layer formed on the peripheral surface of the aluminum cylinder. It rotates in the direction indicated by an arrow mark at a preset process speed (peripheral velocity). The charge roller 52 is in connection to an unshown high voltage power source, from which charge bias (high voltage: combination of AC voltage and DC voltage in FIG. 6) is applied to the charge roller 52. It is in contact with the peripheral surface of the photosensitive drum 51. Thus, as the charge bias is applied to the charge roller 52, the peripheral surface of the photosensitive drum 51 is uniformly charged. That is, the charge roller 52 charges the photosensitive drum 51 by being provided with the charge bias. After the charging of the peripheral surface of the photosensitive drum 51, an electrostatic image is formed on the peripheral surface of the photosensitive drum 51, based on the information of the image to be formed. The electrostatic image formed on the photosensitive drum 51 is moved toward the developing apparatus 53 by the rotation of the photosensitive drum 51.

In the developing apparatus 53, development bias high voltage (development DC in FIG. 6) is applied to the development sleeve 55 by an unshown high voltage power source. Thus, the negatively charged toner of which the toner image is made of, is transferred from the development sleeve 55 onto positively charged points (positive relative to development sleeve 55, and negative relative to GND) of the peripheral surface of the photosensitive drum 51. That is, the latent image on the peripheral surface of the photosensitive drum 51 is developed into a visible image formed of the toner. Then, the toner image is moved toward the primary transfer roller 47 (transferring means) by the further rotation of the photosensitive drum 51. That is, the developing apparatus 53 develops the electrostatic image formed on the peripheral surface of the photosensitive drum (image bearing member) with the use of toner, by being provided with development bias. After the development of the electrostatic image formed on the peripheral surface of the photosensitive drum 51 into the toner image, the toner image is transferred (primary transfer) onto an intermediary transfer belt 44*b*, which will be described later. The regulating blade 54 is disposed in contact with the peripheral surface of the photosensitive drum 51. It cleans the peripheral surface of the photosensitive drum 51 by removing such residues as the transfer residual toner that is remaining on the peripheral surface of the photosensitive drum 51 after the primary transfer of the toner image.

The intermediary transfer unit 44 has: multiple rollers, more specifically, a driver roller 44*a*, an idler roller 44*d*, and primary transfer rollers 47*y*, 47*m*, 47*c* and 47*k*; and the intermediary transfer belt 44*b* (member onto which toner image is transferred) suspended and tensioned by these rollers. The primary transfer rollers 47*y*, 47*m*, 47*c* and 47*k* are disposed so that they oppose the photosensitive drums 51*y*, 51*m*, 51*c* and 5*k*, respectively, and are in contact with the intermediary transfer belt 44*b*.

As the primary transfer bias (transfer bias), which is positive high DC voltage, is applied to the intermediary transfer belt 44*b* by the primary transfer roller 47, the negatively charged toner images on the photosensitive drums 51 are sequentially transferred in layers onto the intermediary transfer belt 44*b*. That is, the primary transfer roller 47 transfers the toner images formed on the photosensitive drums 51, onto the intermediary transfer belt 44*b*, by being provided with the primary transfer bias (primary transfer bias in FIG. 6), in the transferring position P4. The secondary transferring portion 45 has: a secondary transfer inside roller 45*a* and a secondary transfer outside roller 45*b*. The full-color toner image formed on the intermediary transfer belt 44*b* is transferred onto the sheet S of recording medium by applying to the secondary transfer outside roller 45*b*, the secondary transfer bias, which is positive high DC voltage. The fixing portion 46 has a fixation roller 46*a* and a pressure roller 46*b*. As the sheet S bearing the full-color toner image is conveyed between the fixation roller 46*a* and pressure roller 46*b* while remaining pinched between the two rollers 46*a* and 46*b*, the toner image transferred onto the sheet S is heated and pressed, whereby the toner image becomes fixed to the sheet S.

The sheet discharging portion 60 has: a pair of discharge rollers 61 disposed on the downstream side of the sheet discharging passage; a discharge opening 62 with which the downstream wall of the apparatus main assembly 10 in terms of the sheet conveyance direction is provided. The pair of discharge rollers 61 is capable of conveying the sheet S through its nip, and discharging the sheet S through the discharge opening 62 as the sheet S is conveyed to them. After being discharged through the discharge opening 62, the sheet S is deposited in the delivery tray 63, or onto the preceding sheet S in the delivery tray 63.

Figure 2:
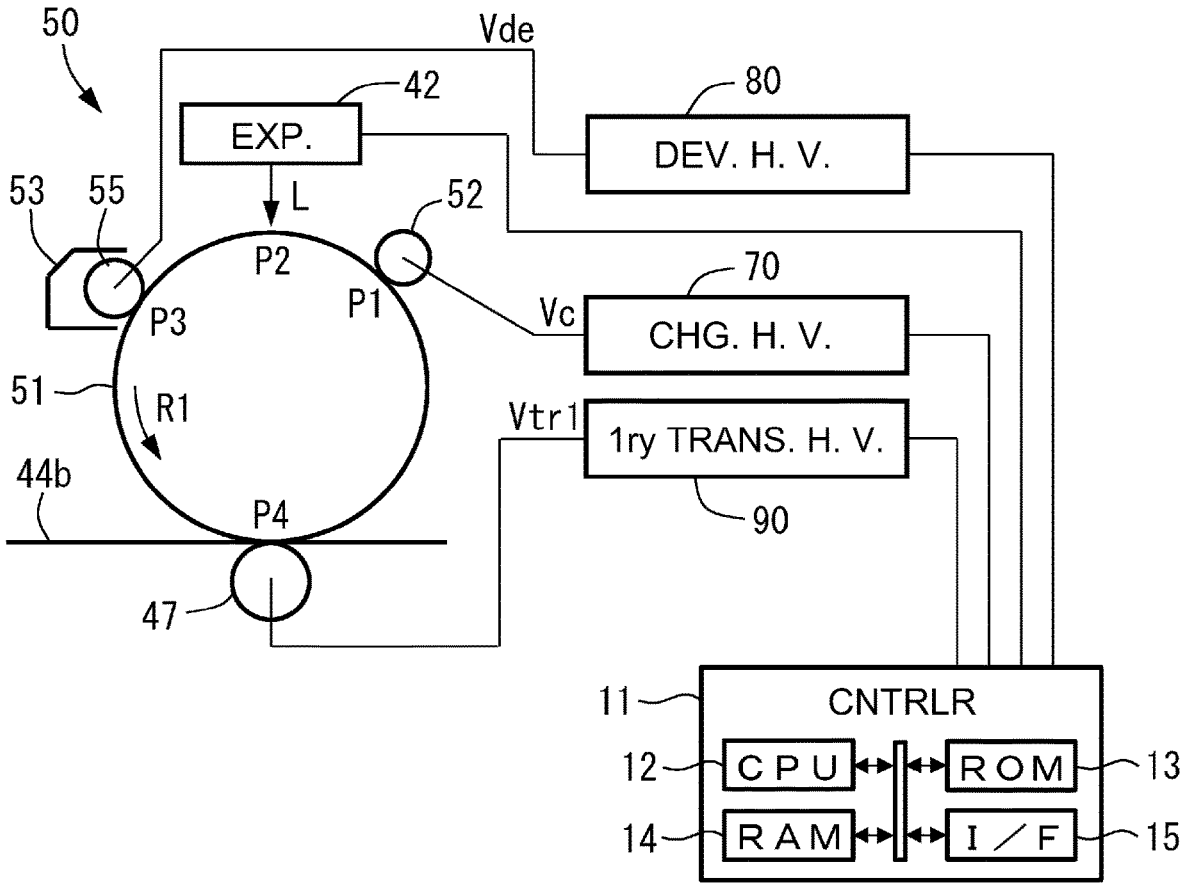
FIG. 2 is a block diagram of a combination of the process units in the adjacencies of the peripheral surface of the photosensitive drum, and various high voltage units in the image forming apparatus in the first embodiment, which shows the structure of the combination.

Referring to FIG. 2, the controlling portion 11 is made up of a computer. For example, it has: a CPU 12; a ROM 13 in which the programs for controlling various portions of the image forming apparatus 1 are stored; a RAM in which data are temporarily stored; and an input/output circuit 15 (I/F) which exchanges signals with external portions. The CPU 12 is a microprocessor which controls the entirety of the image forming apparatus 1. It is the primary system controller. It is in connection to the sheet feeding-conveying portion 30, image forming portion 40, and sheet discharging portion 60 through the input/output circuit 15. Not only does it exchange signals with various portions of the image forming apparatus 1, but also, controls their operations.

Figure 6:
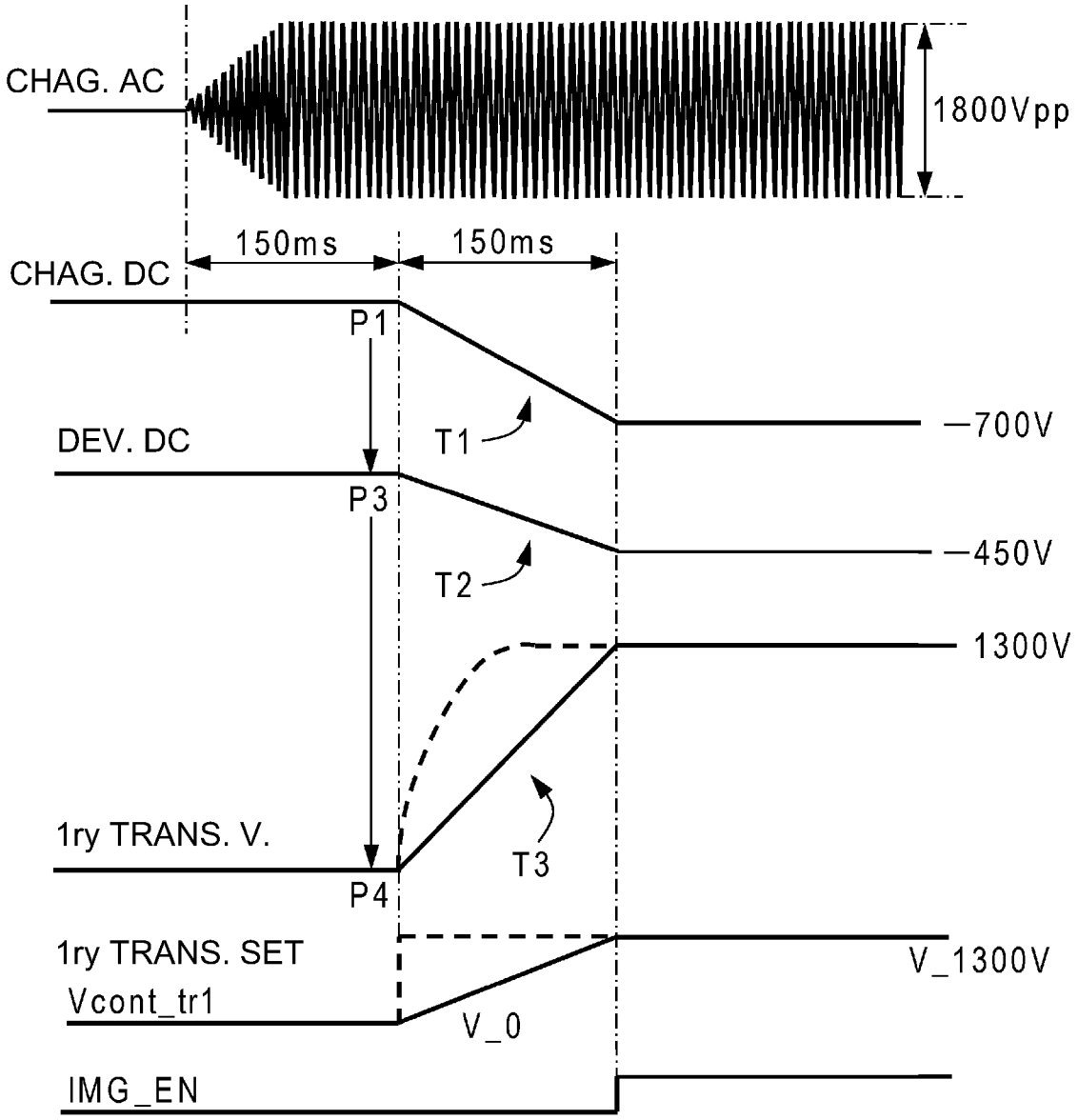
FIG. 6 is a drawing for describing the state in which each of the high voltages is when a given point of the peripheral surface of the photosensitive drum is in the charging position, developing position, and primary transferring position.

The controlling portion 11 controls the image forming apparatus 1 in such manner that the primary transfer bias begins to rise with such timing that the area of the peripheral surface of the photosensitive drum 51, which moved past the charging position P1 when the charge bias began to rise, moves past the transferring position P4 (FIG. 6). Further, the controlling portion 11 controls the image forming apparatus 1 in such a manner that the primary transfer bias finishes rising with the same timing as the area of the photosensitive drum 51, which moved past the charging position P1 when the charge bias finished rising, moves past the transferring position P4 (FIG. 6). In this embodiment, the timing with which the area of the peripheral surface of the photosensitive drum 51 which moved past the charging position P1 when the charge bias begins to rise, moves past the transferring position P4 is referred to as the "charge bias application start area passing timing". Further, the timing with which the area of the peripheral surface of the photosensitive drum 51, which moved past the charging position P1 when the charge bias finish rising, moves past the transferring position P4, is referred to as "charge bias rise completion area passing timing".

The controlling portion 11 controls the image forming apparatus 1 so that the primary transfer bias begins to rise between the charge bias starting area passing timing and charge bias rise completion area passing timing. Further, the controlling portion 11 controls the image forming apparatus 1 so that the primary transfer bias finishes rising to the preset level within a preset length of time after it began rising, after the passing of the charge bias rise completion area passing timing.

The controlling portion 11 controls the image forming apparatus 1 so that the length of time between the charge bias rise start area passing timing and the timing with which the charge bias begins to rise falls within 20% of the entire length T1 (FIG. 6) of time it takes for the charge bias to rise to the preset level after it begins to rise. Further, the length of time between the charge bias application start area passing timing and when the primary transfer bias begins to rise falls within 10% of the entire length T1 (FIG. 6) of the rise time of the charge bias. In this embodiment, the controlling portion 11 sets the length of time between the charge bias rise completion area passing timing and when the primary transfer bias finishes rising to 0. That is, the controlling portion 11 controls the image forming apparatus 1 so that the primary transfer bias finishes rising during the charge bias rise completion area passing timing (FIG. 6).

The controlling portion 11 controls the image forming apparatus 1 so that the length of time between the charge completion area passing timing and when the primary transfer bias finish rising to the preset level falls within 20% of the entire length T1 (FIG. 6) of time it takes for the charge bias to rise to the preset level after it begins to rise. Further, the controlling portion 11 controls the image forming apparatus 1 so that the length of time between the charge completion area passing timing and when the primary transfer bias finishes rising to the preset level falls within 10% of the entire length T1 (FIG. 6) of time for the charge bias to rise to the preset level. In this embodiment, the controlling portion 11 sets to 0, the length of time between when the charge bias rise completion area passing timing and when the primary transfer finishes rising falls within and controls the image forming apparatus 1 so that the primary transfer bias finishes rising during the charge completion area passing timing (FIG. 6).

The controlling portion 11 controls the image forming apparatus 1 so that the length of time the period in which the charge bias finishes rising overlaps with the period in which the primary transfer bias rises to the preset level becomes no less than 70% of the entire length of time it takes for the charge bias or primary transfer bias to rise to the preset level (FIG. 6). Further, the controlling portion 11 controls the image forming apparatus 1 so that the length of the above-described overlapping period becomes no less than 80% of the entire length of time it takes for the charge bias or primary transfer bias to rise to the preset level. In this embodiment, the controlling portion 11 controls the image forming apparatus 1 so that the length of the above-described overlapping period becomes no less than 100% of the entire length of time it takes for the charge bias or primary transfer bias to rise to the present level. That is, the controlling portion 11 controls the image forming apparatus 1 so that the former becomes the same as the latter (FIG. 6).

The controlling portion 11 applies a preset primary transfer bias to the primary transfer roller 47 while no image is formed. As it applies the primary transfer bias, it calculates the voltage value of the primary transfer bias for image formation, based on the results from the current detection circuit. Further, the controlling portion 11 controls the image forming apparatus 1 so that during the entire length of rise time T3, that is, from when the primary transfer bias begins to be applied to when the primary transfer bias rises to the preset level, the primary transfer bias gradually and linearly rises (FIG. 6). By the way, the image formation period means the period in which the image forming apparatus 1 is forming a toner image on the photosensitive drum 51 based on the information about the image to be formed, which is inputted from a scanner with which the image forming apparatus 1 is provided, a personal computer, or the like, which is in connection to the image forming apparatus 1. As for the non-image-formation period, it means other periods than the image formation period. For example, it means the sheet intervals in an image formation job, and periods in which the image forming apparatus 1 is not carrying out an image forming job.

The controlling portion 11 is in connection to the charge bias high voltage unit 70, exposing apparatus 42, development bias high voltage unit 80, and primary transfer bias high voltage unit 90 (transfer bias outputting means). It supplies the charge roller 52, development sleeve 55, and primary transfer roller 47 with high voltage by controlling the high voltage circuits 70, 80 and 90, respectively. The charge bias high voltage unit 70 charges the peripheral surface (photosensitive surface) of the photosensitive drum 51 by outputting charge bias Vc (combination of AC high voltage and DC high voltage) to the charge roller 52. The exposing apparatus 42 causes its laser diode, as a light source, to emit light, with the use of its driver circuit. Further, the exposing apparatus 42 projects a beam L of laser light, which is for writing an electrostatic latent image, in such a manner that the beam L scans the peripheral surface of the photosensitive drum 51 in the direction (primary scan direction) which is parallel to the axial line of the photosensitive drum 51, to expose the charged peripheral surface of the photosensitive drum 51 as the photosensitive drum 51 rotates in the direction (secondary scan direction) indicated by the arrow mark R1, in order to form an electrostatic latent image on the charged peripheral surface of the photosensitive drum 51.

The development bias high voltage unit 80 charges the toner in the developer borne on the peripheral surface of the development sleeve 55, by outputting development bias Vde (negative voltage) to the development sleeve 55. As the charged toner comes into contact with the peripheral surface of the photosensitive drum 51, it adheres to the points (which correspond to pixels of electrostatic latent image) of the peripheral surface of the photosensitive drum 51, which were reduced in negative potential by the exposure. That is, the electrostatic latent image on the peripheral surface of the photosensitive drum 51 is developed into a visible image, that is, a toner image. The primary transfer bias high voltage unit 90 attracts the toner in the toner image on the peripheral surface of the photosensitive drum 51 toward the primary transfer roller 47, by outputting the primary transfer bias Vtr1 (positive in polarity; opposite in polarity from toner image) to the primary transfer roller 47. That is, the toner image on the peripheral surface of the photosensitive drum 51 is transferred onto the intermediary transfer belt 44*b*.

Figure 3:
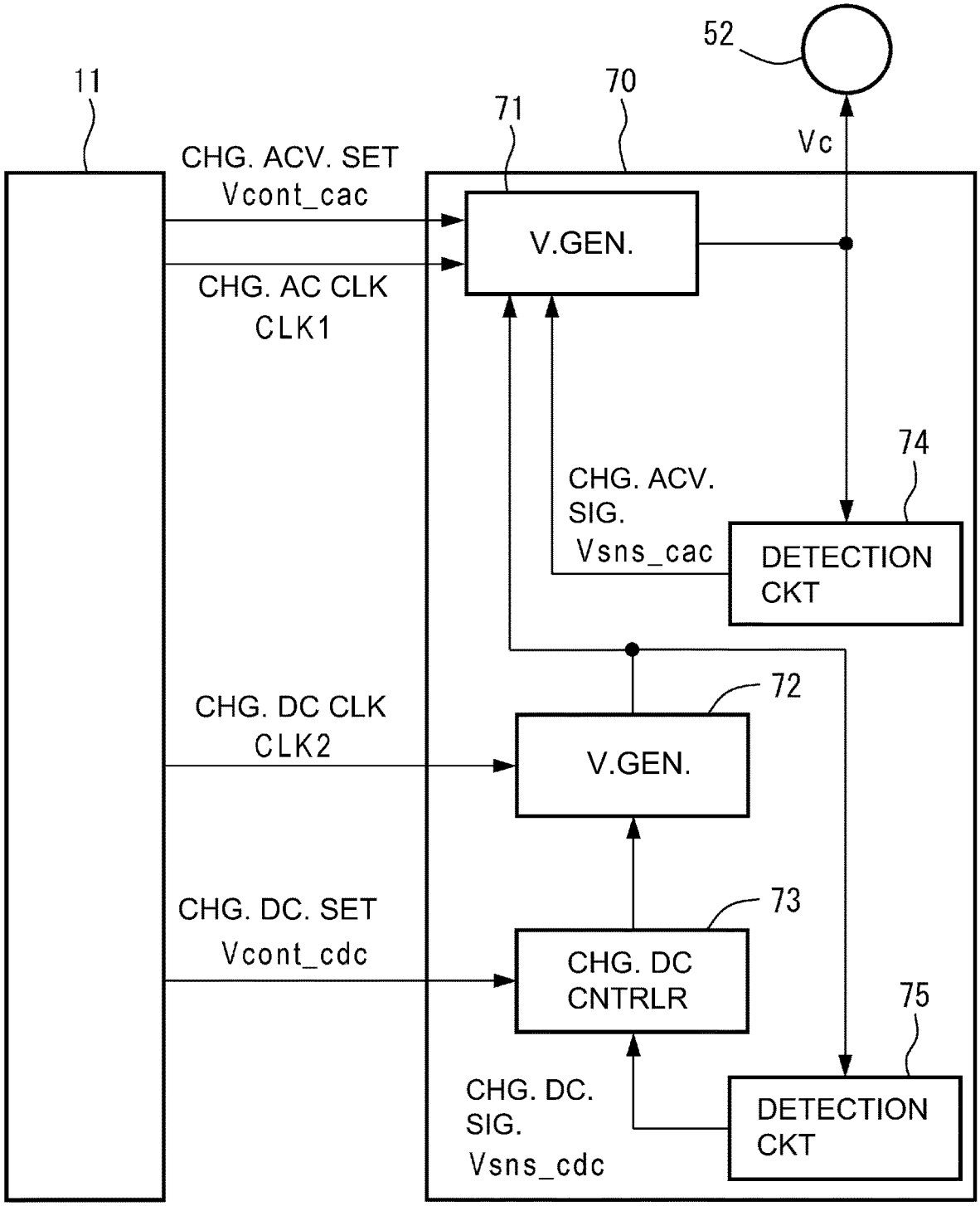
FIG. 3 is a block diagram of the charge bias high voltage unit of the image forming apparatus in the first embodiment, which shows the structure of the charge bias high voltage unit.
Figure 4:
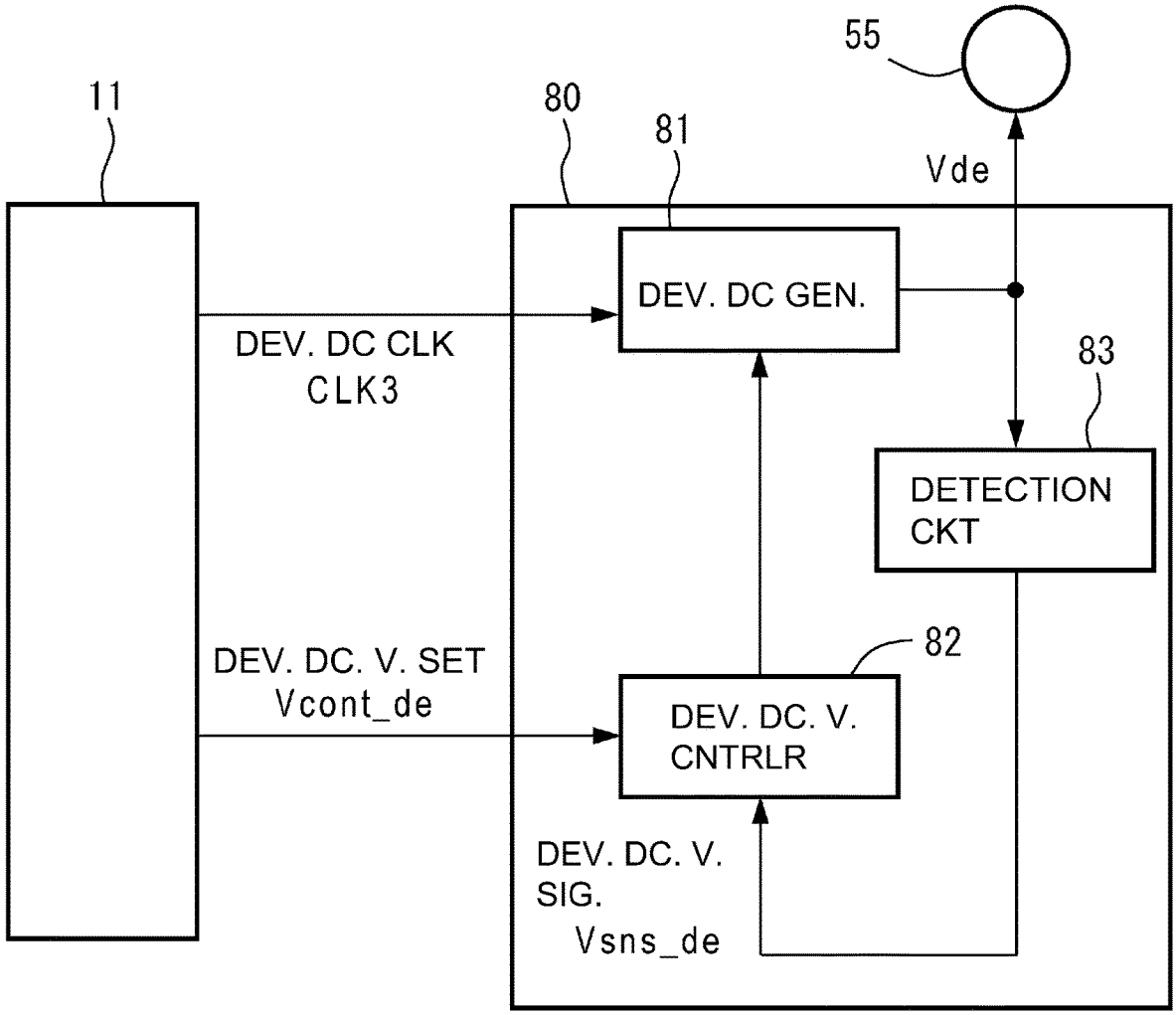
FIG. 4 is a block diagram of the development high voltage unit of the image forming apparatus in the first embodiment.
Figure 5:
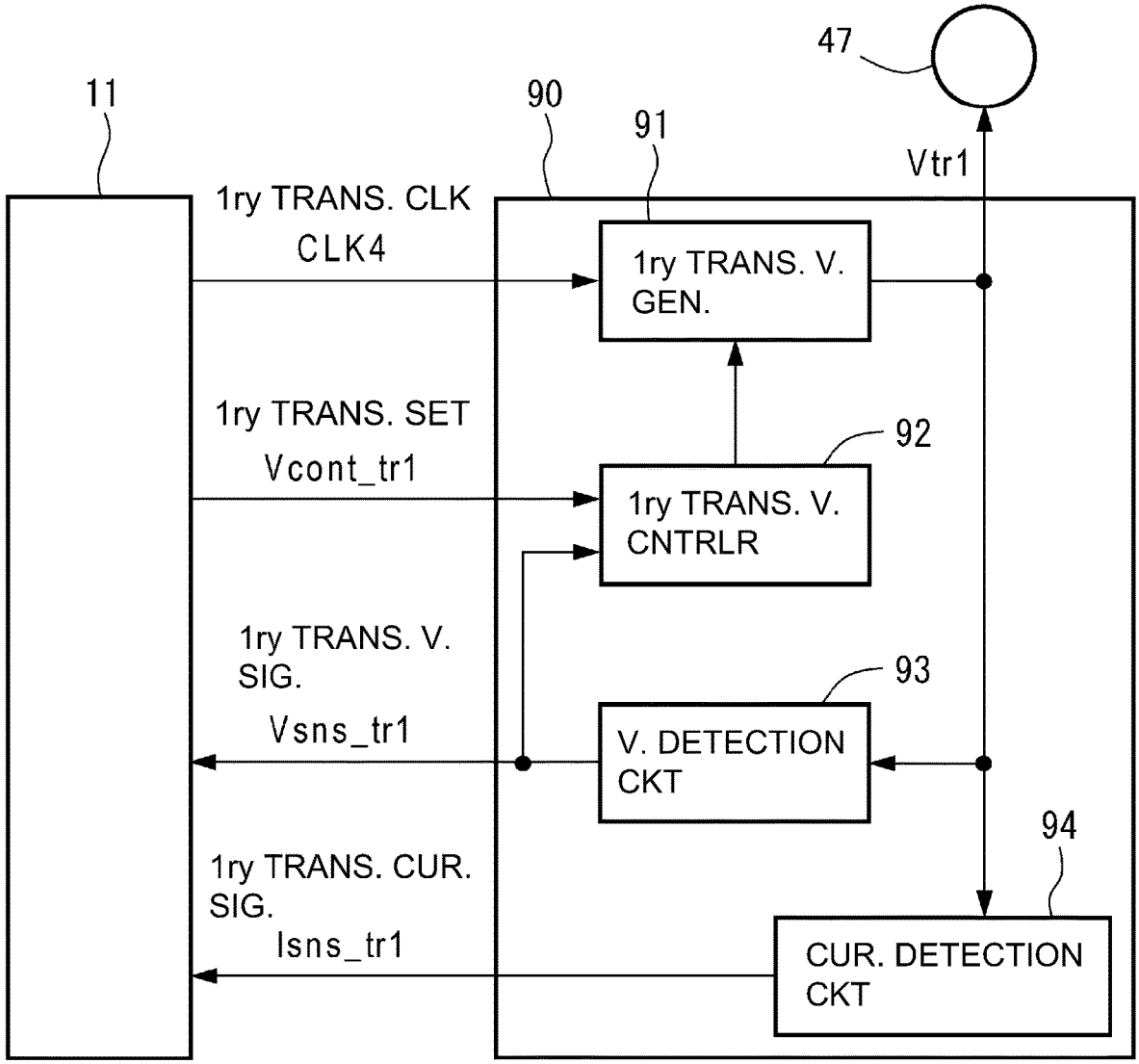
FIG. 5 is a block diagram of the primary transfer bias high voltage unit of the image forming apparatus in the first embodiment.

Next, referring to FIGS. 3-5, examples of high voltage circuits, which are for supplying the photosensitive drum processing portions disposed in the adjacencies of the peripheral surface of each of the photosensitive drum 51 in the image forming apparatus 1, to supply the processing portions with high voltage, are described about their structure.

Referring to FIG. 3, the controlling portion 11 outputs to the charge bias high voltage unit 70, charge bias AC voltage setting signal Vcont-cac, and charge bias AC clock CLK1 for setting the frequency of the waveform of the charge bias AC voltage. Further, controlling portion 11 outputs to the charge bias high voltage unit 70, charge bias DC clock CLK2 for driving the unshown transformer of the charge bias DC high voltage circuit 72, and charge bias DC voltage setting signal Vcont-cdc for setting the value for the DC high voltage of the charge bias high voltage unit 70.

The charge bias high voltage unit 70 has: a charge bias AC high voltage generation circuit 71, a charge bias DC high voltage generation circuit 72, a charge bias DC voltage control circuit 73, a charge bias AC voltage detection circuit 74, and a charge bias DC voltage detection circuit 75. The charge bias high voltage unit 70 outputs high voltage based on the signal from the controlling portion 11, and supplies the charge roller 52 with the high voltage. The charge bias AC high voltage generation circuit 71 and charge bias DC high voltage generation circuit 72 operate in response to the signals from the controlling portion 11. The charge bias high voltage unit 70 outputs a combination of the AC and DC voltages generated by the circuits 71 and 72, respectively.

The charge bias DC voltage control circuit 73 controls (feedback control) the charge bias DC high voltage generation circuit 72 so that the charge bias DC voltage setting signal Vcont-cdc becomes the same in value as the charge bias DC voltage detection signal Vsns-cdc detected by the charge bias DC voltage detection circuit 75. The charge bias DC voltage detection circuit 75 detects the output voltage of the charge bias DC high voltage generation circuit 72, and inputs the charge bias DC voltage detection signal Vsns-cdc into the charge bias DC voltage control circuit 73. The charge bias DC high voltage generation circuit 72 generates negative DC high voltage set by the charge bias DC voltage setting signal Vcont-cdc, by driving the primary side of the unshown transformer in response to the charge bias DC clock CLK2, and outputs the negative DC high voltage.

The charge bias AC high voltage generation circuit 71 outputs AC high voltage which is equal in frequency to the frequency of the charge bias AC clock CLK1, has sinusoidal waveform, and the amplitude of which is set by the charge bias AC voltage setting signal Vcont-cac. The charge bias AC voltage detection circuit 74 detects the Vpp of the AC high voltage outputted from the charge bias AC high voltage generation circuit 71, and outputs to the charge bias AC high voltage generation circuit 71, such charge bias AC voltage detection signal Vsns-cac which corresponds to Vpp. The charge bias AC high voltage generation circuit 71 is controlled (feedback control) so that the charge bias AC voltage setting signal Vcont-cac becomes the same in value as the inputted charge bias AC voltage detection signal Vsns-cac. It outputs the combination of AC and DC voltages to the charge roller 52.

Referring to FIG. 4, the controlling portion 11 outputs to the development bias high voltage unit 80, the development bias DC clock CLK3 for driving the unshown transformer of the development bias DC high voltage generation circuit 81, and a development bias DC voltage setting signal Vcont-de for setting the value for the DC high voltage to be generated by the development bias high voltage unit 80.

The development bias high voltage unit 80 has a development bias DC voltage control circuit 82, a development bias DC high voltage generation circuit 81, and a development bias DC voltage detection circuit 83. It outputs negative high voltage based on the signal from the controlling portion 11, and provides the development sleeve 55 with the high voltage. The development bias DC voltage control circuit 82 is controlled (feedback control) so that the development bias DC voltage Vsns-de detected by the development bias DC voltage detection circuit 83 becomes the same in value as the development bias DC voltage setting signal Vcont-de. It outputs negative DC high voltage to the development sleeve 55. The development bias DC voltage detection circuit 83 detects the output voltage of the development bias DC high voltage generation circuit 81, and inputs the development bias DC voltage detection signal Vsns-de into the development DC voltage control circuit 82. The development bias DC high voltage generation circuit 81 generates DC high voltage set in value by the development bias DC voltage setting signal Vcont-de, by driving the primary side of the unshown transformer in response to the development bias DC clock CLK3, and outputs the DC high voltage.

Referring to FIG. 5, the controlling portion 11 outputs primary transfer clock CLK4 for driving the unshown transformer of the primary transfer bias high voltage generation circuit 91, to the primary transfer bias high voltage unit 90. Further, the controlling portion 11 outputs to the primary transfer bias high voltage unit 90, primary transfer voltage setting signal Vcont-tr1 for setting value for the DC high voltage to be outputted by the primary transfer bias high voltage unit 90.

The primary transfer bias high voltage unit 90 has a primary transfer voltage control circuit 92, a primary transfer bias high voltage generation circuit 91, a primary transfer voltage detection circuit 93, and a primary transfer current detection circuit 94 (current detection circuit). It outputs high voltage in response to the signal from the controlling portion 11, and supplies the primary transfer roller 47 with the high voltage. The primary transfer voltage detection circuit 92 controls the primary transfer bias high voltage generation circuit 91 so that the primary transfer voltage detection signal Vsns-tr1 detected by the primary transfer voltage detection circuit 93 becomes the same in value as the primary transfer voltage setting signal Vcont-tr1. It outputs DC high voltage to the primary transfer roller 47.

The primary transfer voltage detection circuit 93 detects the output voltage of the primary transfer bias high voltage generation circuit 91, and inputs the primary transfer voltage detection signal Vsns-tr1 to the primary transfer voltage control circuit 92 and control portion 11. The primary transfer voltage generation circuit 91 generates and outputs high DC voltage set in properties by the primary transfer voltage setting signal Vcont-tr1, by driving the primary side of the unshown transformer in response to the primary transfer clock CLK4.

The primary transfer current detection circuit 94 detects the output current of the primary transfer bias high voltage unit 90 while no image is formed by the image forming apparatus 1. Then, it outputs the primary transfer current detection signal Isns-tr1 to the controlling portion 11. That is, the primary transfer current detection circuit 94 can detect the current which flows to the primary transfer roller 47. The controlling portion 11 computes the resistance value of the primary transfer roller 47 from the primary transfer current detection signal Isns-tr1, and computes the amount of the primary transfer voltage to be applied to the primary transfer roller 47 while the image forming apparatus 1 forms an image (ATVC). That is, in the case of the image forming apparatus 1 in this embodiment, the controlling portion 11 controls the primary transferring portion so that the voltage between the image-free portion of the peripheral surface of the photosensitive drum 51 and the primary transfer roller 47 remains constant at a preset level, and computes the resistance value of the primary transfer roller 47 based on the preset level and the value of the current which flows to the primary transfer roller 47. Then, during an image forming operation, it controls the primary transfer high voltage unit 90 so that the voltage to be applied to the primary transfer roller 47 remains stable at the level determined in consideration of the environment in which the image forming apparatus 1 is used, and the cumulative length of usage of the image forming apparatus 1 (ATVC).

At this time, before the image forming apparatus 1 is described about its operation for applying high voltage to the peripheral surface of its photosensitive drum, a comparative image forming apparatus is described about the same operation. FIG. 10 shows the state of each of various high voltages applied to a given point of the peripheral surface of the photosensitive drum in the comparative image forming apparatus. By the way, it is assumed here that this image forming apparatus also computes the value for the primary transfer output voltage to be applied to the primary transfer roller 47 during an image forming operation, by carrying out the ATVC while no image is formed.

Referring to FIG. 10, the axis of abscissa represents elapsed length of time. Regarding the waveform of each of various high voltages applied to the photosensitive drum, it is designed so that the value of each of various voltages applied to a given point of the peripheral surface of the photosensitive drum is plotted on the same point on the axis of abscissa. That is, the charge bias DC voltage begins to rise 150 ms after the charge bias AC voltage begins to rise. It rises to −700 V within 150 ms. Further, the development bias DC begins to rise with such a timing that the point of the peripheral surface of the photosensitive drum, which was in the charging position P1 when the charge bias DC voltage began to rise, arrives at the developing position P3. The development bias DC rises to −450 V within 150 ms. Further, the primary transfer voltage begins to rise 150 ms after the point of the peripheral surface of the photosensitive drum, which was in the developing position P3 when the development bias DC began to rise, reaches the transferring position P4.

A trigger signal IMG-EN for starting an image forming operation is outputted from the controlling portion 11, after 120 ms, which is an estimated length of time necessary for the primary transfer voltage to become stable at the target level obtained through ATVC, elapses after the primary transfer bias high voltage begins to be outputted. The trigger signal IMC-EN is such a signal that instructs the exposing apparatus to start a writing operation which exposes the peripheral surface of the photosensitive drum to a beam L of laser light.

It is assumed here that the estimated length of time it takes for the primary transfer voltage to become stable at the target level obtained through ATC after the primary transfer voltage begins to be outputted is 120 ms, for the following reason: The primary transfer voltage is outputted while being controlled so that the output current value becomes a preset one (40 μA, for example). However, the patterns (waveforms) in which the primary transfer voltage/current rises are affected by the impedance of the primary transfer roller 47, which is affected by the environment in which the image forming apparatus is used, cumulative length of usage of the primary transfer roller 47, etc. The current waveform b1 represents the case in which the impedance of the primary transfer roller 47 is the smallest (in consideration of environment in which image forming apparatus is used, cumulative usage of primary transfer roller 47 (image forming apparatus), etc.). In this case, it takes 50 ms for the output current to become stable in value at 40 μA after the primary transfer voltage began to be outputted. Further, the voltage output changes as shown by a voltage waveform a1. A current waveform b2 represents a case in which the impedance of the primary transfer roller is normal (in consideration of the environment in which image forming apparatus is used, the cumulative usage of primary transfer roller (image forming apparatus), etc.). It takes 80 ms for the output current to become stable in value at 40 μA after the primary transfer voltage begins to be outputted. Further, in this case, the output voltage changes as shown by a voltage waveform a2. A current waveform b3 represents a case in which the impedance of the primary transfer roller 47 is the largest (in consideration of the environment in which image forming apparatus is used, the cumulative usage of primary transfer roller (image forming apparatus), etc.). In this case, it takes 120 ms for the output current to become stable in value at 40 μA after the primary transfer voltage begins to be outputted. Further, the output voltage changes as indicated by the voltage waveform a3. Thus, the length of time it takes for the output voltage (output current) to become stable in value has to be estimated in consideration of the case in which the primary transfer output is slowest as indicated by the current waveform b3, as well as the above-described fluctuation of the impedance of the primary transfer roller 47. Thus, it is estimated to be 120 ms.

Next, referring to FIGS. 6 and 7, the image forming apparatus 1 in this embodiment is described about its operation for applying high voltage to the peripheral surface of the photosensitive drum 51. By the way, it is assumed here that it is while no image is formed by the image forming apparatus 1 that the ATVC control is carried out to compute the level at which primary transfer voltage is to be applied to the primary transfer roller during an image formation period.

Referring to FIG. 6, the axis of abscissa represents elapsed length of time. Regarding the pattern (waveform) in which each of various high voltages is applied to the photosensitive drum 51, FIG. 6 is designed so that the value of each of various voltages applied to a given point of the peripheral surface of the photosensitive drum is plotted on the same point on the axis of abscissa. That is, the charge bias DC voltage begins to rise 150 ms after the charge bias AC voltage begins to rise. It gradually and linearly rises from 0 V to −700 V, which is the target level, within 150 ms after the charge bias AC voltage began to rise. Further, the development bias DC voltage begins to rise with such a timing that the point of the peripheral surface of the photosensitive drum, which was in the charging position P1 when the charge bias DC voltage began to rise, reaches the developing position P3. The development bias DC rises from 0 V to −450 V, which is the target bias, within 150 ms. Further, the primary transfer voltage begins to rise with such a timing that the point of the peripheral surface of the photosensitive drum 51, which is in the developing position P3 when the development bias DC voltage began to rise, reaches the transferring position P4. It gradually and linearly rises to 1300 V, which is the target level, 150 ms after it begins to rise. It is assumed here that the length of time from when each bias begins to rise to when it reaches its target level is referred to as the "entire rise time". In this embodiment, the entire rise time T1 of the charge bias DC voltage, entire rise time T2 of the development bias DC voltage, entire rise time T3 of the primary transfer bias voltage are made the same, which is 150 ms.

In the case of the conventional image forming apparatus, the control portion abruptly changes in level the primary transfer voltage setting signal Vcont-tr1 from a level V_0 to level V_1300 (indicated by broken line in FIG. 6). In this case, the primary transfer voltage rises at a high speed (indicated by broken line in FIG. 6). Thus, the unintended stairstep in surface potential level of the photosensitive drum becomes large, making it possible for the image forming apparatus to output an image having unintended horizontal stripes.

In comparison, in the case of the image forming apparatus 1 in this embodiment, the controlling portion 11 gradually changes the primary transfer voltage setting signal Vcont_tr1 in signal level from level V_0 to level V_1300 V in such a manner that it linearly increases. Thus, the primary transfer voltage changes from 0 V to 1300 V in 150 ms (rise time).

In consideration of the fluctuation of the impedance of the primary transfer roller 47 or the like factors, the rise time for the primary transfer voltage is set longer than the maximum length of time which is necessary for the primary transfer voltage output to fully rise in a case where the signal level is abruptly changed as in the case of a conventional image forming apparatus. In this embodiment, therefore, the length of the rise time is set to 150 ms, which is longer than the maximum length of time (120 ms) necessary for the primary transfer voltage to fully rise in a case where the primary transfer voltage setting signal Vcont_tr1 is abruptly changed in signal level from level V_0 to level V_1300. Thus, the controlling portion 11 outputs the image forming operation start trigger signal IMG-EN 150 ms after the primary transfer voltage begins to be outputted. The IMG-EN is such a signal that instructs the exposing apparatus 42 to start the writing operation for exposing the peripheral surface of the photosensitive drum 51 to a beam L of laser light.

Next, a preset range in which the controlling portion 11 can prevent the image forming apparatus 1 from outputting an image having unintended horizontal stripes and the like is described in terms of the relationship between the surface potential of the photosensitive drum 51 and the transfer current which flows into the photosensitive drum 51. Referring to part (a) of FIG. 7, the area on the bottom side of a solid line 100 in part (a) of FIG. 7 is where (preset range) the unintended horizontal stripes or the like, the occurrence of which is attributable to the effect of the primary bias upon the surface potential level of the photosensitive drum 1, do not occur, whereas the area on the top side of the solid line 100 is where the unintended horizontal stripes or the like occur. In this embodiment, the unintended horizontal stripe is defined as an area of an image, which is greater in density by no less than 0.2 than a proper level. In the case of the relationship shown in part (a) of FIG. 7, the density was measured by a reflection densitometer (model 504: product of X-Rite Co., Ltd.). By the way, one of the characteristics of the photosensitive drum 51 is that it does not naturally attenuate in potential. Thus, when a given point of the peripheral surface of the photosensitive drum 51, which was charged in the charging position P1, arrives at the transferring position P4, the potential level of this point is the same as the voltage level of the charge bias applied to the photosensitive drum 51 in the charging position P1.

In this embodiment, the primary transfer output voltage is set to such a level (1300 V) that when the surface potential level of the photosensitive drum 51 is −700 V, the amount of the primary transfer current becomes 40 μA (point 101 in part (a) of FIG. 7). The point 101 is in the area which is on the bottom side of the solid line 100, that is, in the area in which it does not occur that the unintended horizontal stripes or the like occur due to the effect of the primary transfer bias upon the potential level of the charged photosensitive drum 51. The primary transfer current is discharge current generated by the difference in potential level between the surface potential level of the photosensitive drum 51 and that of the primary transfer roller 47. The relationship between the amount ΔV of difference between the surface potential level and that of the primary transfer roller 47, and the primary transfer current, is defined by Paschen's law.

The broken line 102 in part (a) of FIG. 7 shows the relationship between the surface potential level of the photosensitive drum 51 and primary transfer current, which is based on the relationship between the amount ΔV shown in part (b) of FIG. 7 and primary transfer current. For example, a point 103 in part (a) of FIG. 7 corresponds to a point 104 in part (b) of FIG. 7. It is such a point that as the amount ΔV becomes 500 V, the electrical discharge from the primary transfer roller to the surface of the photosensitive drum 51 begins. At this point in time, the surface potential level of the photosensitive drum 51 is −200 V, and the primary transfer output voltage is 300 V. A point 101 in part (a) of FIG. 7 corresponds to a point 105 in part (b) of FIG. 7, which is where the amount ΔV is 2000 V, and the primary transfer current is 40 μA. At this point in time, the surface potential level of the photosensitive drum 51 is −700 V, and the primary transfer output voltage is 1300 V.

Further, the controlling portion 11 finds the resistance value of the primary transfer roller 47 by carrying out the above-described ATVC. Thus, it can compute the relationship between the primary transfer output voltage and primary transfer output current, from the relationship between the resistance value of the primary transfer roller 47 and surface potential level of the photosensitive drum 51. In this embodiment, the controlling portion 11 controls the primary transfer output voltage so that the primary transfer output current changes in value as indicated by the broken line 102 in part (a) of FIG. 7. In a case where the primary transfer output voltage is made to rise in this manner, while the primary transfer voltage changes from 0 V to 1300 V, the primary transfer current changes in value as indicated by the broken line 102 in part (a) of FIG. 7. That is, the primary transfer current value always remains in the area on the bottom side of the solid line 100 in part (a) of FIG. 7. Therefore, it does not occur that the image forming apparatus 1 outputs an image suffering from such unintended horizontal stripes or the like which are attributable to the effect of the primary transfer bias upon the surface potential level of the photosensitive drum 51.

As described above, in the case of the image forming apparatus 1 in this embodiment, its control portion 11 controls the transfer bias high voltage unit 90 so that the transfer bias begins to rise with the charge bias rise start area passing timing. Further, the controlling portion 11 controls the transfer bias high voltage unit 90 so that the transfer bias finishes rising with the charge bias rise completion area passing timing. Therefore, the image forming apparatus 1 in this embodiment is shorter in ECOT than any conventional image forming apparatus structured so that the transfer bias begins to rise after the portion of the peripheral surface of the photosensitive drum, which moved past the charging position P1 after the charge bias finishes rising, moves past the transferring position P4.

Further, in the case of the image forming apparatus 1 in this embodiment, its control portion 11 makes the primary transfer bias rise after the charge bias rise start area passing timing and before the charge bias rise completion timing. Further, the controlling portion 11 controls the primary transfer bias high voltage unit 90 so that the primary transfer bias finishes rising within a preset length of time after the primary transfer bias begins to rise after the charge bias rise completion area passing timing. Therefore, the image forming apparatus 1 in this embodiment is significantly shorter in FCOT than any conventional image forming apparatus.

Further, in the case of the image forming apparatus 1 in this embodiment, its controlling portion 11 controls the primary transfer bias high voltage unit 90 so that, during the entire rise time T3, that is, the length of time from when the primary transfer bias begins to rise, to when it finishes rising, the surface potential level of the photosensitive drum 51 and the amount of the transfer current which flows into the photosensitive drum 51, falls within a preset range. Therefore, it does not occur that the primary transfer bias is applied when the peripheral surface of the photosensitive drum 51 is insufficiently charged to the negative polarity. Therefore, it does not occur that the peripheral surface of the photosensitive drum 51 is positively charged by the primary transfer bias. Thus, the peripheral surface of the photosensitive drum 51 is unlikely to be become nonuniformly charged due to the effect of the primary transfer bias. Therefore, the image forming apparatus 1 in this embodiment is unlikely to output an image having the unintended horizontal stripes which is attributable to the presence of unintended stairsteps in density in the image.

Further, in the case of the image forming apparatus 1 in this embodiment, the primary transfer bias high voltage is made to gradually and linearly rise with such timing that a given point of the peripheral surface of the photosensitive drum 51, which was in the charging position P1 when the charge DC high voltage began to rise and in the developing position P3 when the development DC high voltage began to rise, arrives at the transferring position P4. Since the primary transfer bias high voltage output is made to gradually rise, it is possible to keep the difference in potential level between the charge bias output and primary transfer output in the preset range in which the unintended horizontal stripes do not occur. Thus, the image forming apparatus 1 in this embodiment is shorter in FCOT than the conventional image forming apparatus, by 120 ms (FIG. 10), which is equal to the length of time it takes for the primary transfer bias high voltage output to rise to the target level after the aforementioned given point arrives at the transferring position P4.

Further, in the case of the image forming apparatus 1 in this embodiment, the entire rise time T1 of the charge bias, and the entire rise time T3 of the primary transfer bias, completely overlap with each other. That is, the ratio at which the entire rise time T3 of the primary transfer bias overlaps with the entire rise time T1 of the charge bias, is 100%. Therefore, the image forming apparatus 1 in this embodiment is highly effective to prevent the peripheral surface of the photosensitive drum 51 from becoming nonuniformly charged, and therefore, is highly unlikely to output images which suffer from unintended horizontal stripes attributable to the presence of unintended stairsteps in density in the image.

By the way, in the above-described first embodiment, the image forming apparatus 1 was an image forming apparatus of the so-called tandem type. However, the first embodiment is not intended to limit the present invention in scope in terms of apparatus type. That is, the present invention is also applicable to various image forming apparatuses of other types than the tandem type. That is, an image forming apparatus to which the present invention is to be applied does not need to be a full-color apparatus. That is, the present invention is also applicable to a monochromatic or black-and-white apparatus. Further, not only is the present invention applicable to an image forming apparatus such as the one described above, but also various other printing machines, copying machines, facsimile machines, and multifunction machines. Further, in this embodiment, the image forming apparatus 1 had the intermediary transfer belt 44*b*, and was structured so that after it transfers (primary transfer) toner images, different in color, from the photosensitive drums 51 onto the intermediary transfer belt 44*b*, it transfers (secondary transfer) all at once the toner images on the intermediary transfer belt 44*b*, of which a multicolor image is formed on the intermediary transfer belt 44*b*, onto a sheet S of recording medium. However, this embodiment is not intended to limit the present invention in scope in terms of apparatus structure. That is, the present invention is also applicable to an image forming apparatus of such a type that is structured so that the toner images formed on the photosensitive drums, one for one, are directly transferred onto a sheet S of recording medium conveyed by a sheet conveying belt. In such a case, all that is necessary is to control the transfer bias output to the transferring means for transferring the toner image formed on the peripheral surface of the photosensitive drum onto a sheet of recording medium (object onto which toner image is to be transferred), in the same manner as the primary transfer bias output.

Further, the image forming apparatus 1 in this embodiment is set so that it takes 150 ms (T3), which is the same as the lengths T1 and T2 of time it takes for the charge bias high voltage output and development bias high voltage output, respectively, to gradually and linearly rise to the preset level, for the primary transfer bias high voltage output to gradually and linearly rise to the preset level. However, the first embodiment is not intended to limit the present invention in scope in terms of the length of time it takes for the primary transfer bias high voltage output to rise to the preset level. That is, all that is necessary is that the difference in potential level between the charge DC high voltage output and the potential level of the primary transfer bias high voltage output remains within the area on the bottom side of the solid line in part (a) of FIG. 7, where the unintended horizontal stripes do not occur. Thus, the entire length T3 of time it takes for the primary transfer bias high voltage output to gradually and linearly rise to the preset level may be set to be longer, or shorter, than the entire lengths T1 and T2 of time it takes for the charge bias high voltage output and development bias high voltage output to gradually and linearly rise to their preset levels, respectively.

For example, in the case of an image forming apparatus, the bias application timing of which is shown in FIG. 6, its control portion 11 controls the apparatus so that the primary transfer bias begins to rise with the same timing as when the point of the peripheral surface of the peripheral surface of the photosensitive drum 51, which moves past the charging position P1 when the charge bias begins to rise, moves past the transferring position P4. That is, the application of the primary transfer bias is started at the same time as when the point of the peripheral surface of the photosensitive drum 51, which is in the charging position P1 when the charging bias begins to be applied, arrives at the transferring position P4. In this case, the difference in length of time between when the charge bias application start position of the photosensitive drum 51 arrives at the transferring position P4, to when the primary transfer bias begins to be applied, is zero. Further, in the case of the bias application timings shown in FIG. 6, the controlling portion 11 controls the image forming apparatus 1 so that the transfer bias finishes rising with the same timing as the portion of the peripheral surface of the photosensitive drum 51, which moved past the charging position P1 when the charge bias finished rising, moves past the transferring position P4. That is, the application of the primary transfer bias is ended at the same time as the charge bias application completion point of the photosensitive drum 1 arrives at the transferring position P4. In this case, the difference in length of time between when the charge bias application completion point of the photosensitive drum 51 arrives at the transferring position P4 and when the application of the primary transfer bias is ended, is zero.

However, it is unnecessary for the length of time between when the charge bias rise completion point of the photosensitive drum 51 arrives at the transferring position P4 and when the primary transfer bias finishes rising to be zero as described above. That is, the image forming apparatus 1 may be controlled by the controlling portion 11 so that the timing with which the primary transfer bias finishes rising, corresponds with the timing with which the portion of the peripheral surface of the photosensitive drum 51, which moved past the charging position P1 when the charge bias finishes rising, moves past the transferring position P4.

Since the startup operation is controlled to accommodate the above-described timings, the controlling portion 11 can control the image forming apparatus 1 so that the length of time which elapses from when a given point of the peripheral surface of the photosensitive drum 51 moves past the charging position P1 to when the primary transfer bias begins to rise falls within 20% of the entire length T1 of time it takes for the charge bias to rise to the preset level. That is, it is acceptable even if the timing with which the charging bias application start point of the photosensitive drum 51 arrives at the transferring position P4 is different from the timing with which the primary transfer bias begins to be applied, as long as the difference in timing falls within the above-described range, or the controlling portion 11 may control the image forming apparatus 1 so that the length of time which elapses from the charge bias rise completion area passing timing to when the primary transfer bias finishes rising falls within 20% of the entire length T1 of time it takes for the charge bias to finish rising. That is, the timing with which the charge bias rise completion point of the peripheral surface of the photosensitive drum 51 arrives at the transferring position P4 may be different from the timing with which the primary transfer bias finishes rising, as long as the above-described difference falls within the above-described range. Also in these cases, the length of time between when the charge bias begins to rise and when the primary transfer bias begins to rise, or the length of time between when the charge bias finishes rising and when the primary transfer bias finishes rising, is close to zero. Therefore, it is less likely for the peripheral surface of the photosensitive drum 51 to be nonuniformly charged, and therefore, it is unlikely for the image forming apparatus 1 to output an image which has unintended stairsteps in density and unintended horizontal stripes.

Further, it is not mandatory that the image forming apparatus 1 is controlled so that each of the above-described differences in the length of time falls within 20% of the total length of time it takes for the primary transfer bias to rise to the preset level. For example, the image forming apparatus 1 may be controlled so that the differences fall within 10% of the total rise time T1 of the charge bias. In this case, the control is more effective to prevent the photosensitive drum 51 from becoming nonuniformly charged. Therefore, it is preferable.

Further, in this embodiment described above, the ratio at which the period (entire rise time T3 of primary transfer bias) in which the primary transfer bias rises from 0 V to the preset level overlaps with the period (length T1 of time it takes for charge transfer bias to fully rise) in which the charge bias rises from 0 V to the preset level is 100%. However, this embodiment is not intended to limit the present invention in scope in terms of this ratio. That is, the image forming apparatus 1 may be designed so that the controlling portion 11 controls the apparatus 1 so that the length of time the period T1 in which the charge bias rises to the preset level overlaps with the period T3 in which the primary transfer bias fully rises becomes no less than 70% of the entire rise time of the primary transfer bias or the entire rise time of the charge bias. Also in this case, it is possible to reduce the image forming apparatus 1 in the level of nonuniformity at which the photosensitive drum is charged. By the way, from the standpoint of reducing the image forming apparatus in terms of the nonuniformity in the potential level of the peripheral surface of the photosensitive drum, the length of the above-described overlapping is desired to be set to be no less than 80% of the total length of time it takes for the charge bias or transfer bias to fully rise.

Further, the timing with which the primary transfer bias high voltage output begins to gradually and linearly rise, and the timing with which it finishes rising, respectively, may be set so that they do not coincide with the timing with which the charge bias high DC voltage output begins to gradually and linearly rise and finishes rising, and the timing with which the develop bias high DC voltage output begins to rise and finishes rising, at a given point of the peripheral surface of the photosensitive drum 51. Further, the length of time for the primary transfer high voltage output to gradually and linearly rise may be set according to each of such factors as the environment in which the image forming apparatus 1 is used, cumulative length of usage of the charge roller 52, cumulative length of usage of the primary transfer roller 47, sheet type, and the like.

Embodiment 2

Next, referring to FIGS. 8 and 9, the second embodiment of the present invention is described in detail. This embodiment is different from the first embodiment in image forming apparatus structure in that in this embodiment, the primary transfer voltage setting signal Vcont_tr1 is switched in multiple steps (switched every preset length of time) while the primary transfer output rises. Otherwise, this embodiment is the same as the first embodiment. That is, the charge bias high voltage unit 70, development bias high voltage unit 80, primary transfer bias high voltage unit 90, etc., are the same as the counterparts in the first embodiment in structure and high voltage outputting operation. Thus, they, and their portions, are given the same referential codes as those given to the counterparts, and are not described in detail.

Referring to FIG. 8, the axis of abscissa represents elapsed length of time. Regarding the pattern (waveform) in which each high voltage changes, the value of each high voltage which is applied to the same point of the peripheral surface of the photosensitive drum 51 is plotted at the same point of the elapsed time axis. That is, the charge bias DC voltage begins to rise 150 ms after the charge bias AC voltage beings to rise from 0 V. Then, it gradually and linearly rises to −700 V, which is the target level. Further, the development bias DC voltage begins to rise with the same timing as the portion of the peripheral surface of the photosensitive drum 51, which was in the charging position P1 when the charge bias DC voltage begins to rise from 0 V, arrives at the developing position P3. Then, the development bias DC voltage gradually and linearly rises to −450 V, which is the target level, in 150 ms.

Further, the primary transfer voltage begins to rise with the same timing as the point of the peripheral surface of the photosensitive drum 51, which was developing position P3 when the development DC begins to rise, arrives at the transferring position P4. Then, it rises to 1300 V, which is the target level, in five steps 150 ms after it begins to rise. That is, the controlling portion 11 causes the primary transfer bias to rise in steps throughout the entire length T3 of time from when it makes the primary transfer bias to begin to rise to when the primary transfer bias finishes rising.

First, the controlling portion 11 switches the primary transfer voltage setting signal Vcont_tr1 from the level V_0 (which is 0 V) to level V_260 (which is 260 V) to change the primary transfer output voltage from 0 V to 260 V. Then, the controlling portion 11 switches the primary transfer voltage setting signal Vcont_tr1 30 ms after it switches the primary transfer voltage setting signal Vcont_tr1 from level V_0 to level 260. Here, the controlling portion 11 switches the primary transfer voltage setting signal Vcont_tr1 from level V_260 (which is 260 V) to level V_520 (which is 520 V) to change the primary transfer output voltage from 260 V to 520 V.

Further, the controlling portion 11 switches the primary transfer voltage setting signal Vcont_tr1 30 ms after it switches the primary transfer voltage setting signal Vcont_tr1 from level V_260 to level V_520. Here, the controlling portion 11 changes the primary transfer output voltage from 520 V to 780 V by switching the primary transfer voltage setting signal Vcont_tr1 from level V_520 (which is 520 V) to level V_780 (which is 780 V). Further, the controlling portion 11 switches the primary transfer voltage setting signal Vcont_tr1 30 ms after it switches the primary transfer voltage setting signal Vcont_tr1 from level V_520 to level V_780. Here, the controlling portion 11 changes the primary transfer output voltage from 780 V to 1040 V by switching the primary transfer voltage setting signal Vcont_tr1 from level 780 (which is 780 V in primary transfer voltage output voltage) to level V_1040 (which is 1040 V in primary transfer voltage output voltage). Then, the controlling portion 11 switches the primary transfer voltage setting signal Vcont_tr1 30 ms after it switches the primary transfer voltage setting signal Vcont_tr1 from level V_780 to level V_1040. Here, the controlling portion 11 changes the primary transfer output voltage from 1040 V to 1300 V by switching the primary transfer voltage setting signal Vcont_tr1 from level V_1040 (which is 1040 V in primary transfer voltage output voltage) to level V_1300 (which is 1300 V in primary transfer voltage output voltage).

In the case of the image forming apparatus 1, the length of each of five sub-periods in the period in which the primary transfer bias is made to rise in five steps, one for one, to the target level obtained through the ATVC, after the starting of the outputting of the primary transfer bias high voltage, is 30 ms, which is longer than the longest time necessary for the primary transfer bias high voltage output to fully rise in a case where the primary transfer voltage setting signal Vcont_tr1 is switched so that the primary transfer voltage output voltage abruptly rises to the level determined through the ATVC.

The controlling portion 11 outputs the image formation operation start trigger signal IMG_EN 30 ms after it switches the primary transfer voltage setting signal Vcont_tr1 from level V_1040 (which is 1040 V in primary transfer voltage output voltage) to level V_1300 (which is 1300 V in primary transfer voltage output voltage). By the way, also in this embodiment, the entire rise time T1 of the charge bias DC voltage, the entire rise time T2 of the development bias DC voltage, and the entire rise time T3 of the primary transfer voltage are 150 ms; they are the same in length.

Next, the relationship between the surface potential level of the photosensitive drum 51 and the transfer current which flows into the photosensitive drum 51 is described regarding the range in which the relationship does not cause the image forming apparatus 1 to output an image which suffers from unintended horizontal stripes or the like. Referring to FIG. 9, the area on the bottom side of the solid line 100 is where it does not occur that the nonuniformity in potential level of the peripheral surface of the photosensitive drum 51 causes the image forming apparatus 1 to output an image having unintended horizontal stripes or the like. The area on the top side of the solid line 100 is where the relationship causes the image forming apparatus 1 to output an image having unintended horizontal stripes or the like attributable to the nonuniformity in the potential level of the photosensitive drum 51, which is attributable to the residual effect of the primary transfer bias. Also in this embodiment, the definition of unintended horizontal strip or stripe is an unintended horizontal stripe, which appears in an image in a case where a given long, narrow, and horizontal area of the image is unintendedly different in density by no less than 0.2 from the surrounding area. Further, in the case shown in FIG. 9, the density was measured with the use of a reflection densimeter (Model 504: product of X-Rite Co., ltd.). By the way, one of the characteristics of the photosensitive drum 51 in this embodiment is that the photosensitive drum 51 does not attenuate in potential level unless it is exposed. Thus, when a given point of the peripheral surface of the photosensitive drum 51, which was charged by the charge roller 52 in the charging position P1, came to the transferring position P4, the surface potential level of this point is the same as the level of the charge bias applied to the photosensitive drum 51 in the charging position P1.

A broken line 102 in FIG. 9 represents the relationship between the surface potential level of the photosensitive drum 51 and the amount of the primary transfer current, which is based on the relationship between the voltage ΔV and the amount of the primary transfer current. For example, a point 103 in FIG. 9 corresponds to a point 104 in part (b) of FIG. 7. As the voltage ΔV becomes 500 V, electrical discharge begins from the primary transfer roller 47 to the peripheral surface of the photosensitive drum 51. That is, the point 104 is the point at which the primary transfer current begins to flow. At this point in time, the surface potential level of the photosensitive drum 51 is −200 V, and the primary transfer output voltage is 300 V. A point 101 in FIG. 9 corresponds to the point 105 in part (b) of FIG. 7, where the voltage ΔV becomes 2,000 V and the primary transfer current becomes 40 μA. At this point in time, the surface potential level of the photosensitive drum 51 is −700 V, and the primary transfer output voltage is 1300 V.

A dotted line 106 in FIG. 9 represents the relationship between the surface potential level of the photosensitive drum 51, and the amount of the primary transfer current, which is based on the relationship between the voltage ΔV and the amount of primary transfer current, shown in part (b) of FIG. 7. In a case where the primary transfer voltage output is made to rise in five steps as in this embodiment, the amount of the primary transfer voltage changes in a wavy pattern as indicated by the dotted line 106 in FIG. 9, and therefore, there are areas where the primary transfer current becomes greater than that indicated by the broken line 102.

However, the primary transfer current always remains in the area on the bottom side of the solid line 100. Therefore, it does not occur that the image forming apparatus 1 outputs an image having unintended horizontal stripes attributable to the residual effect of the primary transfer bias upon the surface potential level of the photosensitive drum 51.

As described above, also in the case of the image forming apparatus 1 in this embodiment, the controlling portion 11 controls the image forming apparatus 1 (transfer bias high voltage unit 90) so that the transfer bias begins to rise when the charge bias rise start point of the peripheral surface of the photosensitive drum 51 begins to move past the transferring position P4. Further, the controlling portion 11 controls the primary transfer bias high voltage unit 90 so that the transfer bias finishes rising while the charge bias rise completion point of the peripheral surface of the photosensitive drum 51 moves past the transferring position P4. Therefore, the image forming apparatus 1 in this embodiment is shorter in FCOT than an image forming apparatus controlled so that the transfer bias begins to rise after the area of the peripheral surface of the photosensitive drum 51, which moved past the charging position P1 after the charge bias finished rising, moves past the transferring position P4.

Further, the controlling portion 11 controls the primary transfer bias high voltage unit 90 so that the primary transfer bias finishes rising to the preset level within the preset length of time after the primary transfer bias begins to rise. Further, it controls the primary transfer bias high voltage unit 90 so that the primary transfer bias finishes rising to the preset level after the portion of the peripheral surface of the photosensitive drum 51, which is charged after the charge bias finishes rising to the preset level, arrives at the transferring position P4. Further, it controls the primary transfer bias high voltage unit 90 so that during the period from when the primary transfer bias begins to rise to when the primary transfer bias finishes rising to the preset level, the relationship between the surface potential level of the photosensitive drum 51, and the transfer current which flows into the photosensitive drum 51, falls within the preset range. Therefore, it does not occur that the primary transfer bias is applied to the portion of the peripheral surface of the photosensitive drum 51, which was insufficiently charged to the negative polarity. Therefore, it does not occur that a certain portion of the peripheral surface of the photosensitive drum 51 becomes positively charged. That is, it does not occur that the peripheral surface of the photosensitive drum 51 becomes nonuniformly charged in an unintended pattern. Therefore, it does not occur that the image forming apparatus 1 outputs such an image that suffers from unintended horizontal strips or stripes attributable to the presence of unintended stairsteps in density in the image.

Further, in the case of the image forming apparatus 1 in this embodiment, the output of the primary transfer bias high voltage is increased in five steps. Thus, even if it is abruptly increased in each step, it is possible to prevent the image forming apparatus 1 from outputting an image which suffers from the presence of unintended stairsteps in density and unintended horizontal stripes. Thus, it is easier to control the output of the primary transfer bias high voltage than in the case where the primary transfer bias high voltage unit 90 is controlled so that the output of the primary transfer bias high voltage gradually and linearly rises.

Also in the case of the image forming apparatus 1 in this embodiment, the image forming apparatus 1 (primary transfer bias high voltage unit 90) is controlled so that it is switched (increased in steps) in output for every 30 ms to make the primary transfer bias rise to the preset level in five steps. However, this embodiment is not intended to limit the present invention in scope in terms of the number of steps in which the primary transfer bias rises and the length of time afforded for the primary transfer bias to fully rise. That is, the number of steps and the length of rise time are optional. For example, the steps through which the primary transfer bias rises may be made the same, or different, in length. That is, all that is necessary is that the difference in potential level between the charge bias DC high voltage output voltage and primary transfer bias high voltage output voltage is kept within the area on the bottom side of the solid line 100 in FIG. 9, where no unintended horizontal stripe is generated. That is, the entire length T3 of time through which the primary transfer bias high voltage output is made to rise in steps may be set to be longer or shorter than the entire lengths T1 and T2 of time through which the charge bias high voltage output and development bias high voltage output rise, respectively.

Further, in this embodiment described above, the primary transfer bias high voltage unit 90 is switched in target value for every 30 ms; it is increased in target value in five steps. This embodiment, however, is not intended to limit the present invention in scope in terms of how frequently the primary transfer bias high voltage unit 90 is switched in target value and the length of the rise time of its output. That is, the number of steps through which the primary transfer bias high voltage unit 90 is switched in target level for the output of the primary transfer bias high voltage output, and the duration of each step may be set according to the environment in which the image forming apparatus 1 is used, cumulative length of usage of the charge roller 52 and primary transfer roller 47, recording medium type, and the like factors.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-120233 filed on Jun. 16, 2016, which is hereby incorporated by reference herein in its entirety.

What is claimed is:

1. An image forming apparatus, comprising:

a photosensitive member that rotates;

a charging member configured to charge the photosensitive member at a charging position;

a charging bias applying portion that applies a charging bias to the charging member;

a transfer member configured to transfer a toner image borne on the photosensitive member to a transfer medium at a transfer position;

a transfer bias applying portion that applies a transfer bias to the transfer member, the transfer bias having a polarity opposite to that of the charging bias;

a bias detection portion that detects the transfer bias applied to the transfer member; and a control portion that controls the charging bias applying portion and the transfer bias applying portion, wherein the control portion controls the charging bias applying portion for a start of image formation such that an absolute value of a voltage applied to the charging member is a predetermined bias voltage which is lower than an absolute value of a target charging bias to be set in the image formation at a first predetermined timing in a first period from when the charging bias starts raising at the start of image formation until when the charging bias reaches the target charging bias, and wherein the control portion controls the transfer bias applying portion such that the transfer bias to be applied to said transfer member starts raising in a second period in which a region of the photosensitive member, which passed through the charging portion during the first period, passes through the transfer portion, and an absolute value of the voltage applied to the transfer member is a predetermined transfer bias, which is lower than an absolute value of a target transfer bias to be set in a transferring period in which the toner image is transferred to the transfer medium, at second predetermined timing in the second period based on a detection result of the bias detection portion.

2. The image forming apparatus according to claim 1, wherein the control portion controls the transfer bias applying portion such that the region of the photosensitive member passing through the transfer position during the second period is not charged to the same polarity as that of the transfer bias.

3. The image forming apparatus according to claim 1, wherein the control portion controls the transfer bias applying portion such that the transfer bias applied to the transfer member is linearly increased in the second period.

4. The image forming apparatus according to claim 1, wherein the control portion controls the transfer bias applying portion such that the transfer bias applying portion starts raising the transfer bias after a position of a surface of the photosensitive member having passed the charging position at the time when the charging bias to be applied to said charging member starts raising at the start of image formation passes the transfer position.

5. The image forming apparatus according to claim 1, wherein in the second period, a period from a start of raising the voltage applied to the transfer member to reaching the target transfer bias is not less than 70% of the second period.

6. The image forming apparatus according to claim 1, wherein the control portion controls the transfer bias applying portion such that the transfer bias applied to the transfer member is stepwisely raised in the second period.

7. The image forming apparatus according to claim 1, wherein the control portion controls the transfer bias applying portion so as to stepwisely raise the transfer bias to be applied to the transfer member in not less than four steps.

* * * * *